US008272117B2

(12) United States Patent
Michaud

(10) Patent No.: US 8,272,117 B2
(45) Date of Patent: Sep. 25, 2012

(54) METHOD OF INSTALLING A COMPRESENT INSULATION ARRANGEMENT FOR BUILDING OPENINGS

(76) Inventor: Donald A. Michaud, Marblehead, MA (US)

( * ) Notice: Subject to any disclaimer, the term of this patent is extended or adjusted under 35 U.S.C. 154(b) by 0 days.

(21) Appl. No.: 12/924,062

(22) Filed: Sep. 20, 2010

(65) Prior Publication Data

US 2011/0067349 A1 Mar. 24, 2011

Related U.S. Application Data

(62) Division of application No. 11/800,261, filed on May 4, 2007, now Pat. No. 7,797,891.

(51) Int. Cl.
*E06B 3/277* (2006.01)
*E06B 7/22* (2006.01)

(52) U.S. Cl. ..... 29/451; 29/897.32; 52/208; 49/475.1

(58) Field of Classification Search ..... 29/897.32, 29/897.312, 897.31, 451; 49/475.1; 52/741.4, 52/745.15, 745.16, 204.1, 204.5, 208
See application file for complete search history.

(56) References Cited

U.S. PATENT DOCUMENTS

| | | | | |
|---|---|---|---|---|
| 2,840,869 | A * | 7/1958 | Fegan | 52/208 |
| 3,571,994 | A * | 3/1971 | Brown et al. | 52/209 |
| 3,805,470 | A * | 4/1974 | Brown | 52/204.597 |
| 3,815,303 | A * | 6/1974 | Ziegler | 52/99 |
| 3,925,953 | A * | 12/1975 | LaBorde | 52/745.19 |
| 4,347,693 | A * | 9/1982 | Kruschwitz | 52/208 |
| 4,612,743 | A * | 9/1986 | Salzer | 52/208 |
| 4,835,927 | A * | 6/1989 | Michlovic | 52/204.597 |
| 5,633,048 | A * | 5/1997 | Bodin | 427/444 |
| 6,832,457 | B2 * | 12/2004 | Geiger | 52/656.5 |
| 2003/0056449 | A1 * | 3/2003 | Geiger | 52/204.53 |

* cited by examiner

*Primary Examiner* — David Bryant
*Assistant Examiner* — Jason L Vaughn
(74) *Attorney, Agent, or Firm* — Don Halgren

(57) ABSTRACT

A window frame insulation assembly and sealing arrangement, comprising an elongated, extruded block of foam material having a first or inner side and a second or outer side. A unitary air fin is co-extruded therewith. The air fin comprises an elongated flange of flexible foam material. The air fin and the elongated block define an elongated receiving-channel that is filled with a foam compression rod there between creating a seal for blocking air and moisture from a building in which said window frame assembly has been placed.

11 Claims, 8 Drawing Sheets

METHOD OF INSTALLING A COMPRESENT INSULATION ARRANGEMENT FOR BUILDING OPENINGS

This application is a Divisional application of U.S. patent application Ser. No. 11/800,261, filed May 4, 2007 now U.S. Pat. No. 7,797,891, and incorporated herein by reference in its entirety.

BACKGROUND OF THE INVENTION

1. Field of the Invention

This invention relates to building construction, and more particularly to apparatus and methods for insulating and sealing openings around window and door members by the insertion of an insulation assembly for the perimeter of the opening.

2. Prior Art

Modem construction techniques for buildings which rely on wall cavities to manage water and air infiltration also rely on an "Air Barrier" system. The design of that wall is often comprised of an exterior facade such as brick, stone, composite panels or the like. A wall cavity which varies in width but usually around 2". A supporting wall to the interior often built with concrete block, metal studs with exterior grade gypsum/fiberboard or other structural elements which support insulation, interior walls and finishes.

The air barrier system is a method of controlling air infiltration into the building through the use of air impermeable materials, unique design and inventive techniques. Contemporary building designs are often dependent upon the use of a bituminous/asphalt fabric with a coating of polyethylene sheathing at least 4 mils thick. Common commercial names are Ice and Water Shield® by WR Grace Co. and Cavity Wall Systems® by Carlisle Ind. This material is applied in the cavity area, to the supporting wall side. The application is similar to wallpaper as the bituminous/asphalt body has excellent adhesion to the buildings elements and is pliable enough to wrap around window and door openings. Polyethylene sheathing is the preferred coating for this fabric because it is pliable, resists material degradation when exposed to the elements and is an excellent barrier against wind and water. According to the National Institute of Standards and Technology's investigations, this type of air barrier design can reduce the buildings energy consumption by as much as 32-39%.

Polyethylene resists chemical reaction; the properties of polyethylene make it the preferred material for containers of caulking, acids and the like. The issue for the building Industry is that sufficient adhesion to the polyethylene coated fabric is not easily achieved. Up until now, fluid connections to the air barrier system through the use of spray foam or caulking have not attained the same standards as other components in the air barrier system. Since no adhesives effectively stick to that coating; mechanical fastening has been the state of the Art. To achieve that connection, the window and door industry currently uses perimeter fins or receptor systems of aluminum or vinyl. Before being installed, a sealant is applied to the back of the fin or receptor and compressed behind the assembly to the air barrier. These are then mechanically fastened through the use of nails or screws. This creates an effective attachment.

In addition to that connection, cavities surrounding the window and door inserts are often insulated with sprayable foam mixtures or are stuffed with fiberglass batten insulation. Sprayable foam mixtures are either latex or polyurethane based formulations. Latex sprayable foam mixtures as outlined in U.S. Pat. No. 6,395,794 assigned to DAP Products is an open cell foam product. The object of that invention is to be easily cleaned, toolable, stable, shrink resistant and UV stable. It is however a water soluble product and it is water absorbent. It looses insulating values when damp, it does not expand to entirely fill the void and it will not adhere to polyethylene. Polyurethane sprayable foam mixtures as outlined in U.S. Pat. No. 6,410,609 assigned to Fomo Products are closed cell foams. The object of that product is to expand, but not over-expand, which would result in bending the framing system. Its goal is to fully fill the window cavity. An issue with that application is that excessive foam is not easily controlled or cleaned, it is not UV stable and it will not adhere to the polyethylene sheathing. An issue with all field foaming is that there is a chemical reaction that has to be fully catalyzed. If not, un-catalyzed chemicals will reside in the cavity and may outgas. The process is also temperature dependent limiting its installation range. Once installed, there can be no verification that the cavities contain un-reacted chemicals or that they are fully foamed.

There are window and door products manufactured with the cavities already filled with polyurethane foam. While these products are fully foamed and catalyzed, they do not fill the void between the sash and the receptor or structure. They also have little resiliency, are easily punctured and cannot be bent without breaking. Since foam is a non-load bearing element; installation techniques incorporate an exterior panning system or interior trim/anchoring system. The use of a through sash fastener is not an option because shimming to the foam will not provide adequate support. The use of additional panning systems and trim also raises the "U" value beyond the certified window rating.

Fiberglass batten insulation is often stuffed into the window cavity to fill the voids. No chemical reaction occurs, effecting a clean installation. The problem with this type of installation is that batten insulation absorbs moisture. When it absorbs moisture it looses insulating value, which results in an environment for mold and mildew to develop. It also has no air barrier properties. That product is not intended for use in this type of application.

There is also an air barrier product claimed in U.S. Pat. No. 6,256,956 issued to Davis. This is a vinyl "window wrap" which relies on being filled with either open or closed cell polyvinyl chloride foam or batten insulation. That product is heat sealed to its self, creating a pocket. It is claimed for use on solid wood doors, windows and sliders. It relies on adhesive, sealing tape and staples for mechanical attachment and sealing to a wood structure. There is a foam gasket claimed that can be inserted after the vinyl wrap is attached to the building. The exterior is a one piece, single ply wrap that is folded around the corners. It does not state how it is sealed to itself to achieve that. The thickness of the vinyl is limited to make folding the corners possible. This product requires care when installed so it is not punctured because it will tear. Since it is vinyl, it cannot attach to a polyethylene air barrier membrane. Single ply membranes like this also have a low condensation resistance factor which facilitates mold and mildew growth. This product has yet to achieve commercial use.

The lack of an effective insulator and method of sealing to the buildings air barrier system jeopardizes achieving the buildings energy consumption goals.

It is an object of the present invention to overcome the disadvantages of the prior art.

It is a further object of the present invention to provide a site-customizable insulated window gasket seal and as well as a suitable insulation arrangement therewith.

It is yet still a further object of the present invention, to provide a flexible insulation-adaptable arrangement which will accommodate varying dimensions and misalignment, to properly insulate a window in a wall opening.

It is yet still a further object of the present invention, to provide a flexible insulation-adaptable arrangement which will accommodate varying dimensions and misalignment, to properly seal a window in a wall opening.

It is yet still a further object of the present invention, to provide a flexible insulation-adaptable arrangement which will accommodate varying dimensions and misalignment, to properly flash a window in a wall opening.

It is still yet another further object of the present invention, to provide a window insulation arrangement wherein that insulation is readily sealable both to the window frame itself and to the fenestration wall of the supporting structure.

It is still yet another further object of the present invention; to provide a window insulation arrangement wherein that insulation is readily sealable both to the window frame itself and to the buildings polyethylene sheathed air barrier system.

BRIEF SUMMARY OF THE INVENTION

The present invention relates to an arrangement for fully insulating and properly sealing a window frame assembly within an opening of a wall of a building. The window frame assembly itself comprises a generally rectangular structure, typically made with extruded vinyl or metal (i.e. aluminum) having flange portions which surround a window sash. The rectangular window frame arrangement is insertably disposed within the opening of the wall and sealed therein, only after having had an inventive insulated gasket extrusion block disposed therearound.

The principal function of this insulated gasket extrusion block is that its sealing properties are activated through compression, rather than expansion, as do sprayable foams. This "compression insulation" is designed for each application, purposefully oversized, so that it is compressed when inserted into a hollow frame, creating a seal to the frame. It is unlike sprayable foam products, which are designed to expand in the cavity when applied, thereby creating a seal. This application design entirely fills the voids of the hollow frame, insuring complete insulation of the frame. When completely filled, activation of the thermal bridge is also assured. This cannot be said of sprayable foam products. Once this is achieved, materials hosting this product will realize the following; A) Greater Condensation Resistance Factor (CRF), B) Lower "U" Value Rating (U value), C) Greater Sound Transmission Class rating (STC) and D) Greater Impact Insulation Class rating (IIC).

The "compression insulation" extrusion material is comprised of elongated extruded closed-cell polyethylene foam. This material is commonly used in the packaging industry. It is also used as sound absorbing material in humid atmospheres such as boats. Because of its expense, it is not commonly used as building insulation. Polyethylene is uniquely adaptable to this application because it is by nature, a plastic formulated resin that is impermeable to water and it is also UV stable. As a closed cell foam extrusion, it provides insulation that will not absorb moisture, thereby retaining its insulating values. It also will not create an environment for mold and mildew because it sheds water. "Compression insulation" is ideally suited for the application intended because of its flexibility. That flexibility allows sealing through compression. To further the design, a compressive insulated "air fin" extension, is made to abut the perimeter of a building's fenestration. The material installation is not dependent upon an ambient temperature range, so uncatalized material can never reside in the frame cavity. Unlike vinyl sheathing, it can be punctured but will not easily tear, while maintaining its insulating values. It is a controlled and clean installation that needs no chemical clean-up. The foam assembly exhibits an excellent Condensation Resistant Factor (CRF) unlike single ply membrane such as vinyl.

There are four main components to the design and installation of the "compression insulation" system. The main block portion of the extrusion blocks abut and are matingly inserted generally adjacent the outer perimeter of the window frame assembly. The insulative extrusion blocks have a first or inner side which engages the outer side of the window frame assembly. The first or window side of the elongated extrusion blocks have at least one elongated window frame receiving channel arranged therein so as to provide an isolation of the exterior and interior portion of the perimeter frame. Additional channels, groves and notches are machined or extruded into the main block portion as required to accommodate any anomalies found in the receiving channel.

The elongated extrusion blocks have a second or outwardly directed side which faces the perimeter of the wall opening within the wall of the building in which the window frame assembly is to be inserted. The second side of the elongated extrusion has an elongated foam air fin or wing arrangement which is connected unitarily to the second or outer side of the elongated foam extrusion at a variable point along the second side thereof. The elongated foam air fin has a distal flange portion which extends generally parallel to the second or outer side of the main block portion of the elongated extrusion. It is of generally "h" shape (lower case), in cross section.

An elongated "receiving" channel is thus formed between the outer or second side of the elongated extrusion and an inner facing elongated surface of the foam air fin. The inner surface of the elongated foam air fin may have a plurality of serrations arranged thereon extending the length of the foam air fin. The foam air fin has an outer edge with a plurality of elongated serrations extending the length of the extrusion. The inner length of the surface arrangement for the elongated foam air fin is of greater length than the channel between the second or outer side of the elongated foam block extrusion.

An elongated foam compression rod, made of polyethylene foam material is insertable within the receiving channel between the foam air fin and the outer side of the elongated extrusion block when that elongated extrusion block has been inserted around the perimeter or sides of a window frame after that window and frame has been inserted within an opening within a wall of a building. That compression rod is part of the insulating system of the air-fin assembly. The rod is preferably of generally rectangular shape in cross-section but may be of varying thickness and shapes to accommodate variations in the opening within the wall of the building relative to the perimeter of the window assembly. The foam compression rod is utilized to press against the air fin from its inner wall and is therefore compressively directed against the opening of the wall of the building of which the window has been inserted. That foam compression rod facilitates the air barrier and moisture barrier seal by keeping the foam air fin material tightly compressed against the perimeter of the opening within the wall of the building as well as securely compressing the elongated extrusion arranged adjacent the exterior perimeter of the window frame assembly. The abutment of the air-fin to the building will serve to create a water & vapor barrier when additional sealants are applied.

In a further feature of the present invention, a termination block, generally of L-shape, is adaptable to be inserted at the corners of the window frame assembly. The termination block has a first leg and a second leg, which meets and is joined at a 90 degree angle each having a distal end which is flat and in abutable engagement with its respective air-fin extrusions on their particular portions of the window frame insulation assembly. Each leg may be trimmed to a compression fit according to the field conditions.

Thus each elongated extrusion of the present invention may include at its end, an "L"-shaped termination block to provide the insulative support at the corners of those window assemblies within the wall opening.

The symbiotic nature of the foam compression rod and the polyethylene foam elongated extrusion and the polyethylene foam air fin unitarily formed therewith, work together and thus become a very effective weather barrier and insulator for window assemblies within building walls.

A further aspect of the present invention comprises a thermoplastic attachment of the first or inner side of the elongated extrusion to the thermal bridge on the outer perimeter of the aluminum frames supporting the window assembly. It is further contemplated as an aspect of the present invention, to utilize thermoplastic welding after the elongated extruded insulative members have been installed as a friction fit under compression within the opening of the wall of the building. Attachment to the buildings air barrier polyethylene sheathing is achieved through thermoplastic welding, resulting in an air barrier seal to the structure. There is also thermoplastic welding attachment of all components surrounding the insertable sash. These result in a continuous monolithic insulative gasket surrounding the entire aluminum framed insert.

In addition to the compressible seal and thermal attachments and with modification of the foam extrusion, other sealants and adhesives may also be used to increase adherence between the polyethylene extrusion and the window frame assembly perimeter or the window opening in the building beyond the compressive force.

The additional application of caulking, adhesives, compressible tapes and thermoplastic welding rely on a stable point of contact because they require time for curing to perfect its adhesion against the window frame or the opening of the wall of the building. The compression rod effects the maintenance of that stability by applying steady pressure on the elongated extrusion and upon the elongated air fin co-extruded therewith.

It is to be noted that such an extruded elongated support arrangement of the present invention may be utilized with the door assemblies as well as windows or any other insert which may be sealed into a fenestration in a wall which requires insulation and a seal for overcoming the ravages of weather.

The invention thus includes a window frame assembly insulation and sealing arrangement, for weather-tight insertion into an opening of a wall of a building comprising: an arrangement of elongated, extruded blocks of flexible foam material having a first or inner side and a second or outer side, the first side matable against a window frame assembly, a unitary foam air fin co-extruded therewith, the air fin comprising an elongated flange of flexible foam material, the air fin and the elongated block defining an elongated receiving-channel therebetween, wherein the second or outer side of the block and the air fin are compressed against the opening of the wall. The first side of the extrusion block may have at least one window frame receiving channel therein to engagably mate with an outwardly facing portion of the window frame assembly. The first side of the extrusion block may have a window frame receiving protrusion thereon to engagably mate with an inwardly facing portion of the window frame assembly. The window frame assembly insulation and support arrangement may preferably include a compression rod which is insertably disposed within the elongated receiving-channel between the air fin and the extrusion block, to provide an outwardly directed compressive force upon the air fin and an inwardly directed compressive force upon the elongated extrusion block of foam by the rod, so as to therefore sealingly, compressably force said air fin against a wall opening in a building. The foam comprising the extruded block and the air fin are compression insulation comprised of cross-linked closed cell polyethylene foam with naturally occurring skin of predetermined thickness. The window frame assembly insulation and support arrangement may include a thermoplastic welding arrangement between the window frame and the extrusion blocks. The extrusion block may be generally of "h" shape in cross-section. An "L" shaped termination block may be arranged within the corners of the window frame assembly to abuttingly engage the elongated extruded blocks thereat and provide an airtight weather seal at corners in a wall opening receiving the window assembly.

The invention also includes a method of installing a weather sealable, insulatable window frame assembly in an opening in a wall of a building, comprising one or more of the following steps: providing a metal frame peripherally around a window sash, the frame having channel-forming outwardly projecting flanges therearound; placing an insulating, elongated, extrusion block arrangement within the channel formed by the flanges of metal frame assembly, the extrusion block having an elongated air fin co-extruded therewith; inserting the window assembly with the extrusion block arrangement therearound, into the opening in the building wall; inserting a compression rod into a rod-receiving channel between the air fin and the extrusion block to compress said air fin against the opening in the wall and to compress the extrusion block against the window frame assembly; attaching an energyzable thermoplastic welding means to the outer periphery of the elongated air fin and to the inner periphery of the extrusion block; energyzing the means so as to heat and thermoplastically fuse the foam of the elongated extrusion block and the air fin against their respective adjacent surfaces. The elongated extrusion block may be of "h" shape (lower case) in cross section. The method may include the forming a window frame protrusion receiving channel along an inner side of the elongated extrusion block. The extrusion block may be formed of closed cell polyethylene. The method may include: trimming portions of the compression rod to enable the extrusion block arrangement to conform to dimensional irregularities in the opening in the wall.

The invention also includes a method of installing a weather sealable, insulatable window frame assembly in an opening in a wall of a building, comprising one or more of the following steps of: providing a metal window frame peripherally around a window member, the frame having channel-forming outwardly projecting flanges therearound; placing an inner side of an insulating, elongated, extrusion block arrangement within the channel formed by the flanges of the metal frame assembly, the extrusion block having an elongated air fin co-extruded on an outer side thereof; inserting the window assembly with the extrusion block arrangement therearound, into the opening in the building wall; and inserting a compression rod into a rod-receiving channel between the air fin and the extrusion block to compress the air fin against the opening in the wall and to compress the extrusion block against the window frame assembly; inserting a shim post though the extrusion block and into the wall defining the opening, to secure the extrusion block to the wall defining the opening. The extrusion block and its air fin are of "h" shape (lower case) in cross section, thereby forming the compression rod receiving channel therebetween.

The inventive method may include: thermoplastically welding the inner side of the extrusion block to the metal frame peripherally arranged around said window member; and may include thermoplastically welding the outer side of the air fin to the opening peripherally arranged around the window member; inserting an L-shaped termination block into a corner of the window opening to facilitate a weather seal between adjacent extrusion blocks and the perimeter of the building opening; inserting an L-shaped terminal block into a corner of the window opening to facilitate a weather seal between adjacent extrusion blocks; and forming a plurality of elongated gripping serrations on the air fin to enhance its compressive gripping capabilities thereof.

BRIEF DESCRIPTION OF THE DRAWINGS

The invention's objects and advantages are shown in the drawings.

DETAILED DESCRIPTION OF THE PRESENT INVENTION

Figure 1:
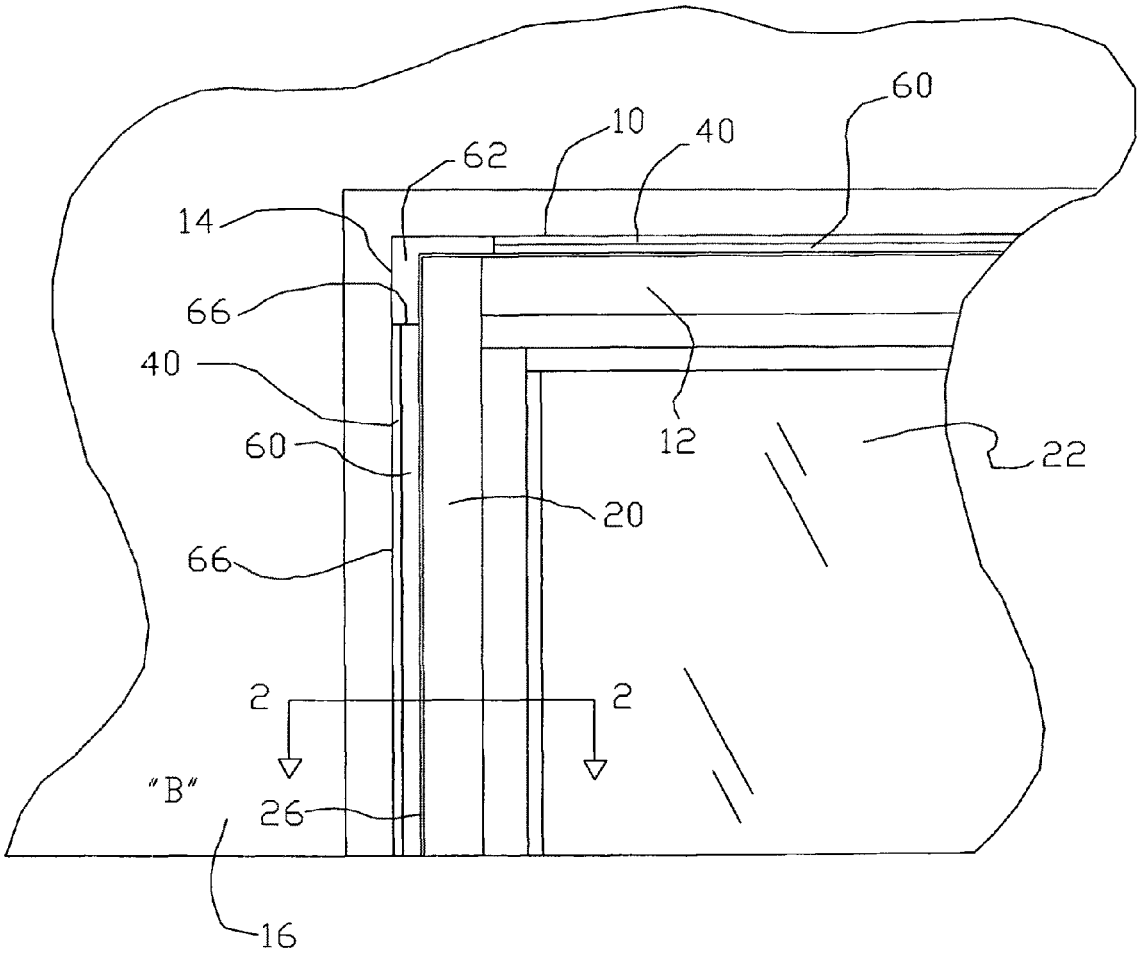
FIG. 1 is an interior elevational view of the upper left hand corner of a window assembly mated into a wall opening of a building.
Figure 2:
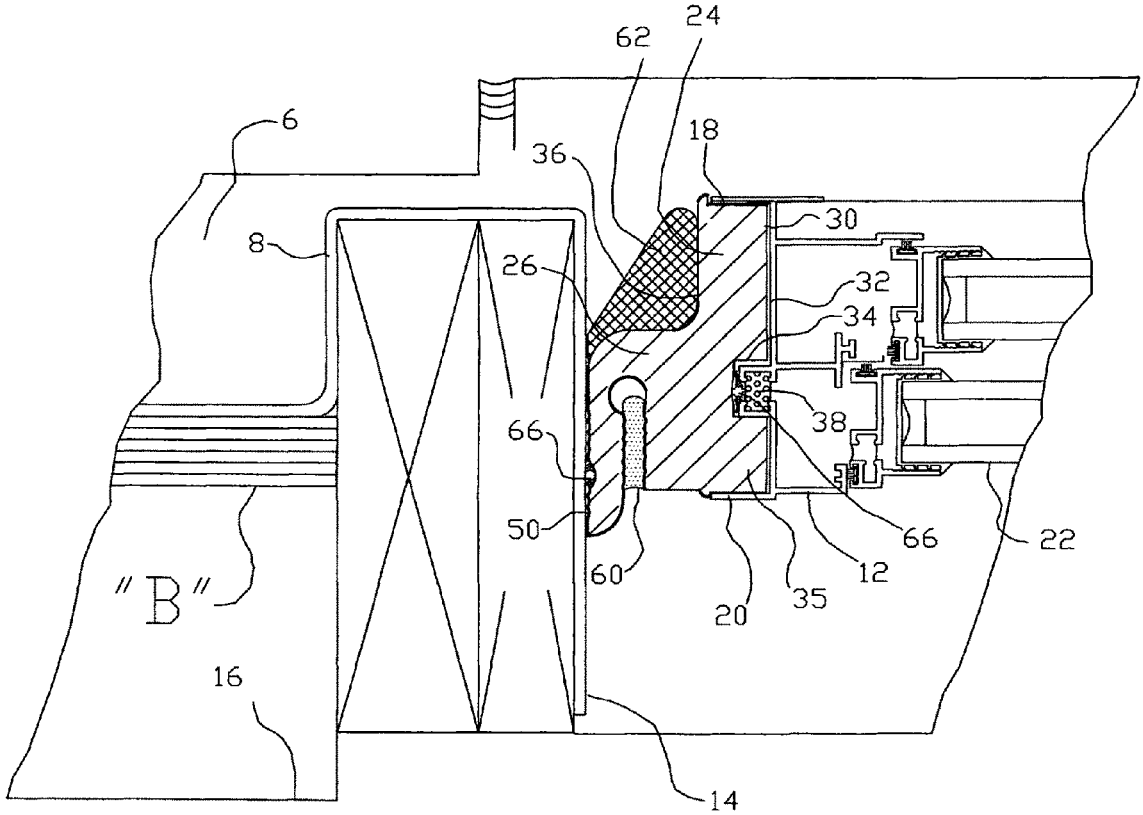
FIG. 2 is a drawing taken along the lines 2-2 of FIG. 1.

Referring now to the drawings in detail, and particularly to FIGS. 1 and 2, there is shown cavity wall construction 6 with a polyethylene coated air and vapor barrier 8 with the present invention which comprises an insulative weather seal 10 and support arrangement supportably enclosing a window frame assembly 12 within an opening 14 of a wall 16 of a building "B". The window frame assembly 12, shown from its side in FIG. 1, and from a cross-sectional view (looking down) in FIG. 2, itself comprises a generally rectangular structure, typically made with extruded material (i.e. aluminum or vinyl) having channel-defining, outwardly extending, first and second flange portions 18 and 20 which surround the window frame 22. The rectangular window frame assembly 12 is insertably disposed within the opening 14 of the wall 16 and sealed therein by an inventive, insulated "extrusion assembly" 24 disposed therearound.

Figure 3:
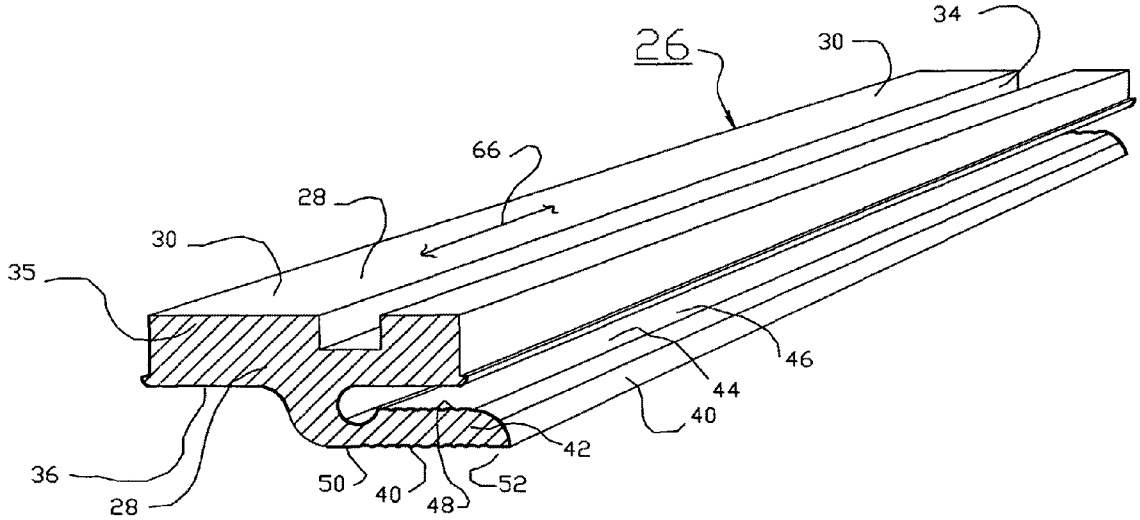
FIG. 3 is a perspective view of an elongated extruded block with its corresponding unitary foam air fin assembly shown therewith.
Figure 4:
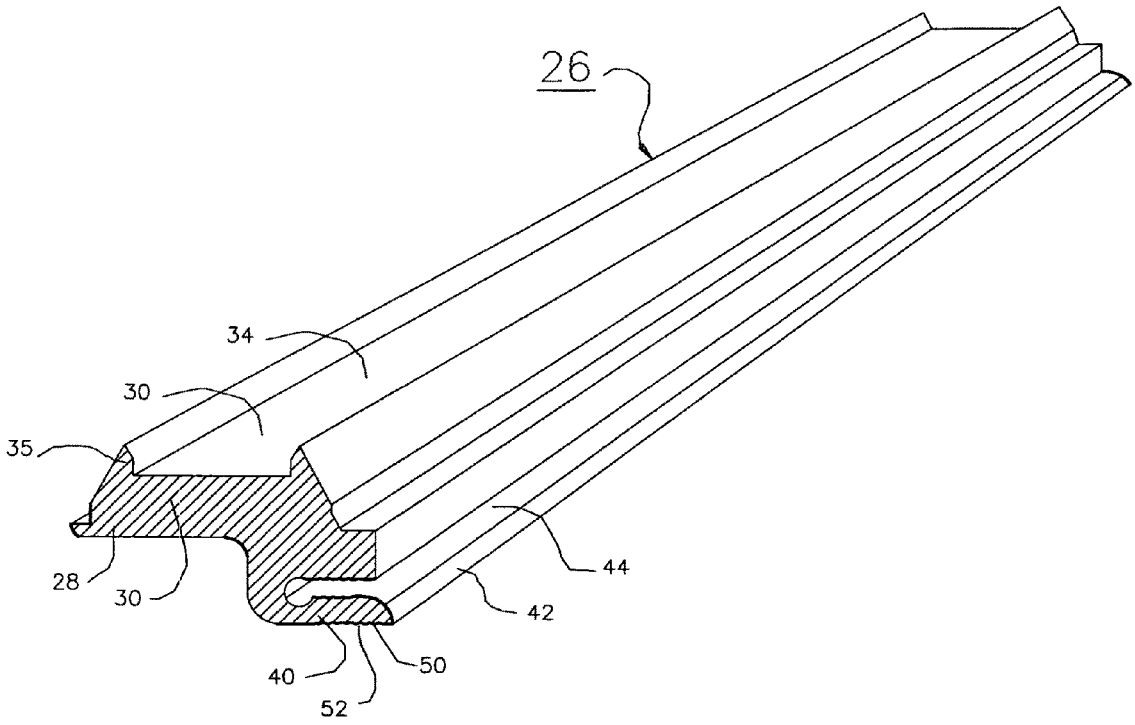
FIG. 4 is a perspective view of a further embodiment of an elongated foam extrusion block and associated air fin arrangement of the present invention.

The extrusion assembly 24 comprises an insulative window perimeter-surrounding generally "h" (lower case) shaped extrusion block 26, shown in a first embodiment in FIG. 3. The extrusion block 26 comprises an elongated closed-cell polyethylene foam having an elongated, main block portion 28 which abuts and matingly slides generally adjacent the outer perimeter of the flanged window frame assembly 12. Each insulative extrusion block 26 has a first or window side 30 which engages the outer (perimeter) side 32 of the window frame assembly 12, as represented in FIG. 1. The first or window side 30 of the elongated extrusion block 26 has at least one elongated window frame receiving channel 34 arranged therein so as to provide a complete infill arrangement between the window frame assembly 12 and each elongated extrusion block 26, as may be seen in FIG. 1.

The elongated extrusion block 26 has a second or outwardly directed side 36 which faces the perimeter of the opening 14 within the wall 16 of the building "B" in which the window frame assembly 12 is to be inserted, as is represented in FIG. 1. The second side 36 of the elongated extrusion 26 has a co-extruded, elongated foam "air fin" or wing arrangement 40 which is connected unitarily (co-extruded) to the second or outer side 36 of the elongated extrusion 26 at varied locations, as may be seen in FIGS. 1, 2, 3, 4, 6 & 7. The elongated foam air fin 40 has a distal flange portion 42 which extends generally parallel to the second or outer side 36 and the main block portion 28 of the elongated extrusion block 26.

An elongated (receiving) channel 44 is thus formed between the outer or second side 36 of the elongated extrusion 26 and an inner facing elongated surface 46 of the foam air fin 40. The inner surface 46 of the elongated foam air fin 40 has a plurality of longitudinally directed "grip-enhancing" serrations 48 arranged thereon extending the length of the foam air fin 40. The foam air fin 40 has an outwardly facing surface 50 preferably with a plurality of corresponding, elongated, grip-enhancing serrations 52 extending the length of the extrusion block 26.

An elongated, extruded compression rod 60 is insertable within the receiving channel 44 between the foam air fin 40 and the outer side 36 of the elongated extrusion block 26 when that elongated extrusion block 26 has been inserted between the flanges 18 and 20 around the perimeter or sides of a window frame assembly 12 after that window 22 and frame assembly 12 has been inserted within an opening 14 within a wall 16 of a building "B". That compression rod 60 is preferably of generally rectangular shape in cross-section, as is represented in FIG. 2, and may however, be of varying cross-sectional shape and or thickness to accommodate unanticipated size variations in the opening 14 within the wall 16 of the building relative to the perimeter of the window assembly 12. The compression rod 60 is utilized to press against both the air fin 40 from its inner wall 46 and is therefore compressively directed against the air fin 40 and the window opening 14, and also simultaneously against the window frame 20 as well as the opening 14 of the wall 16 of the building "B" in which the window assembly 12 has been inserted. The compression rod 60 is of greater thickness or diameter that the width of the receiving channel 44, so as to effect the compression of the air fin 40 and the extrusion block 26 when the rod 60 is inserted therein. The compressive tightness and grip against surfaces adjacent the air fin 40 is enhanced by the elongated serrations 48 and 50 on that air fin 40. That elongated compression rod 60 thus facilitates the air barrier and moisture barrier sealing by keeping the environmentally resistant skinned foam material of the air fin 40 tightly compressed against the perimeter of the opening 14 within the wall 16 of the building "B" as well as securely simultaneously compressing the elongated extrusion block 26 against its adjacent exterior perimeter 32 of the window frame assembly 12 from an elongated receiving channel 44 located therewithin.

Figure 5:
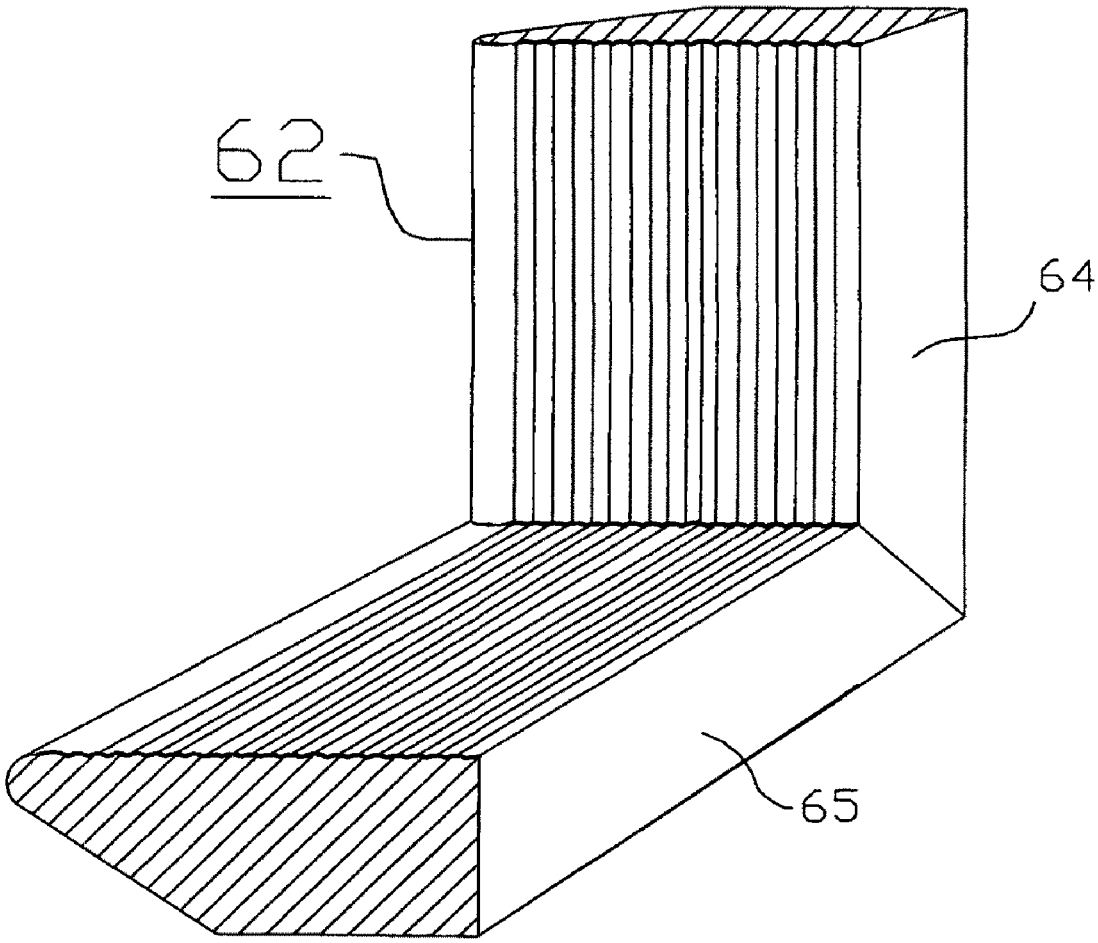
FIG. 5 is a perspective view of a termination block which is utilized in the corners surrounding a window assembly within a wall opening.
Figure 6:
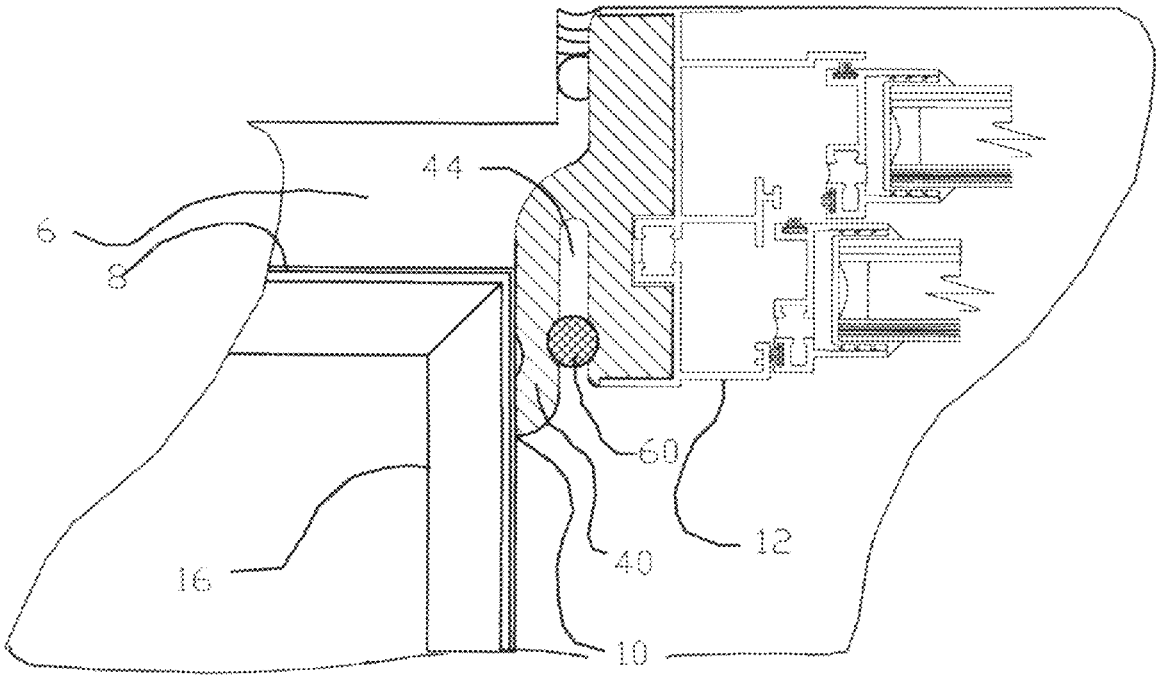
FIG. 6 is a drawing taken along the lines 2-2 of FIG. 1 which shows a further embodiment therewith, comprising a wall cavity without projecting wood blocking and a polyethylene sheathed membrane on the supporting wall.
Figure 8:
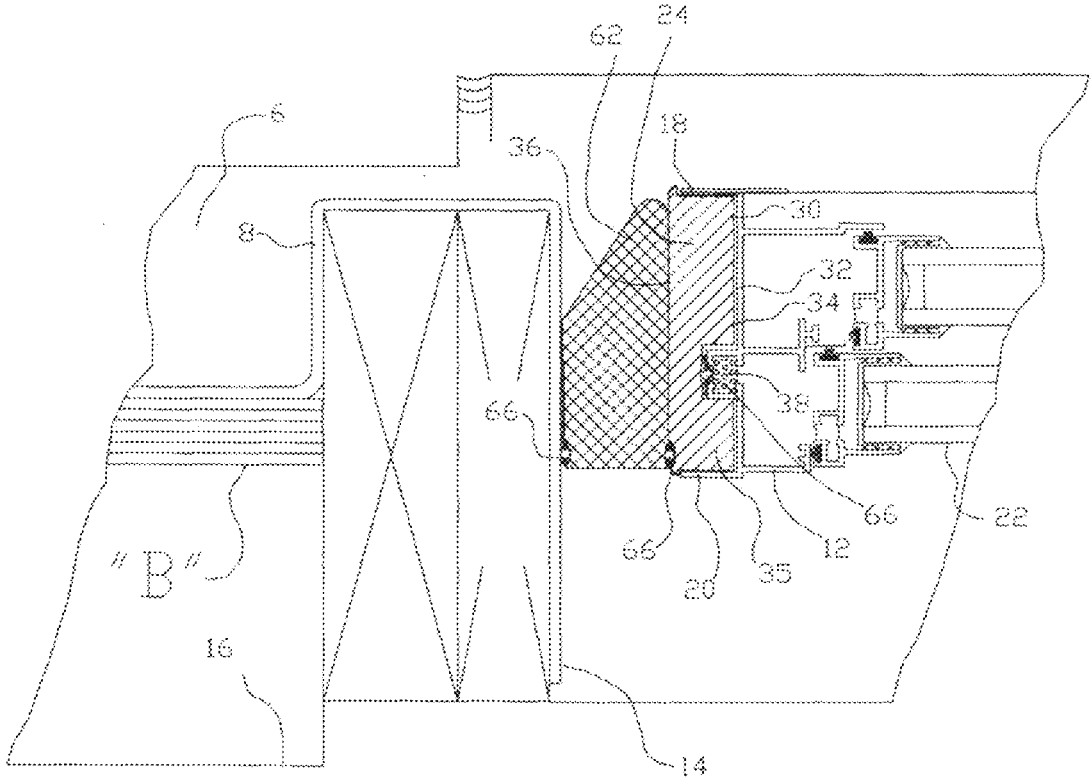
FIG. 8 is a view showing the termination block on skived extrusion.

In a further feature of the present invention, a molded foam termination block 62 generally of "L"-shape, as represented in FIGS. 5 and 8, is adaptable to be inserted at the corners of the window frame assembly 12, as best seen in FIG. 1. The termination block 62 has a first leg 64 and a second leg 65, which meet and are joined at a 90 degree angle, each leg 64 and 65 having a distal end which is flat and in abutable engagement with its respective elongated extrusion blocks 26 at their particular portions at the window frame assembly 12 with its insulative support arrangement 10. The "near end" portions of each extrusion block 26 may be skived or trimmed along its air fin portion 40 to permit a leg 64 or 65 of the terminal block 62 to abut thereagainst and mate snugly in a corner of the window opening 14 and the extrusion block 26 itself.

Thus each elongated extrusion block 26 of the present invention may include at each end thereof, an L-shaped termination block 62 to provide the insulative support at the corners of those window assemblies 12 within the wall opening 14.

It is further contemplated as an aspect of the present invention, to utilize a thermoplastic welding arrangement when the elongated extruded insulative member blocks 26 have been installed as a "friction fit" under compression within the opening 14 of the wall 16 of the building "B". There is preferably a thermoplastic attachment of the outer perimeter of the elongated extrusion block 26 to the inner perimeter of the window opening 14 in the building. A further aspect of the present invention also comprises a thermoplastic attachment of the inner side of the receiving channel 34 of the elongated extrusion block 26 to a thermal bridge 38 located at the perimeter 32 of the aluminum window frame 12. Such thermoplastic attachment may be accomplished through a process of thermoplastic welding high temperature crystalline formula plastic rod or energizably heatable wire or the like 66, and placing the weldment within the receiving channel 34 where it abuttingly compresses against the thermal bridge 38 located in the window assembly 12. The seal at the perimeter of the air fin 40 and the building opening 14 can also be attached through thermoplastic welding, such as for example, a heatable wire or the like 66, or otherwise sealed from the air fin 50 insulation compressively and sealingly 10 against the building opening 14. In the field, during installation of a particular assembly 12 into a particular opening 14 in a building wall 16, compression rods 60, whether round, oval, square or rectangular, may be utilized which have varying thickness by trimming or the like, or separate and distinct compression rods with varying diameters or thicknesses placed end to end within their appropriate channels 44, to accommodate inaccuracies of the window openings 14 which would otherwise be characterized as a misfit.

A caulked adhesive may also be used in addition to the usage of a thermoplastic weld or caulked in place of the thermoplastic weld when the naturally occurring environmentally resistant "skin" of the polyethylene extrusion on the air fin 40 and the skin on the window receiving channel 34 is removed, exposing open plastic cell walls where the caulking is applied to the window opening 14 or the receiving channel 34. The adhesion between the polyethylene extrusion 26 and the perimeter of the thermal bridge 38 or the window opening 14 in the building may be perfected between exposed polyethylene cells and building substrates other than solid polyethylene sheathing.

The symbiotic nature of the compression rod 60 and the polyethylene elongated extrusion block 26 and its polyethylene air fin 40 unitarily formed therewith, work together and thus become a very effective weather barrier and insulator system for window assemblies 12 within building openings.

It is to be noted that such an insulated air barrier system may be utilized with any other insert which may be sealed into a supporting structure which requires insulation and a sealed attachment for overcoming pressurization of wall fenestrations.

Figure 7:
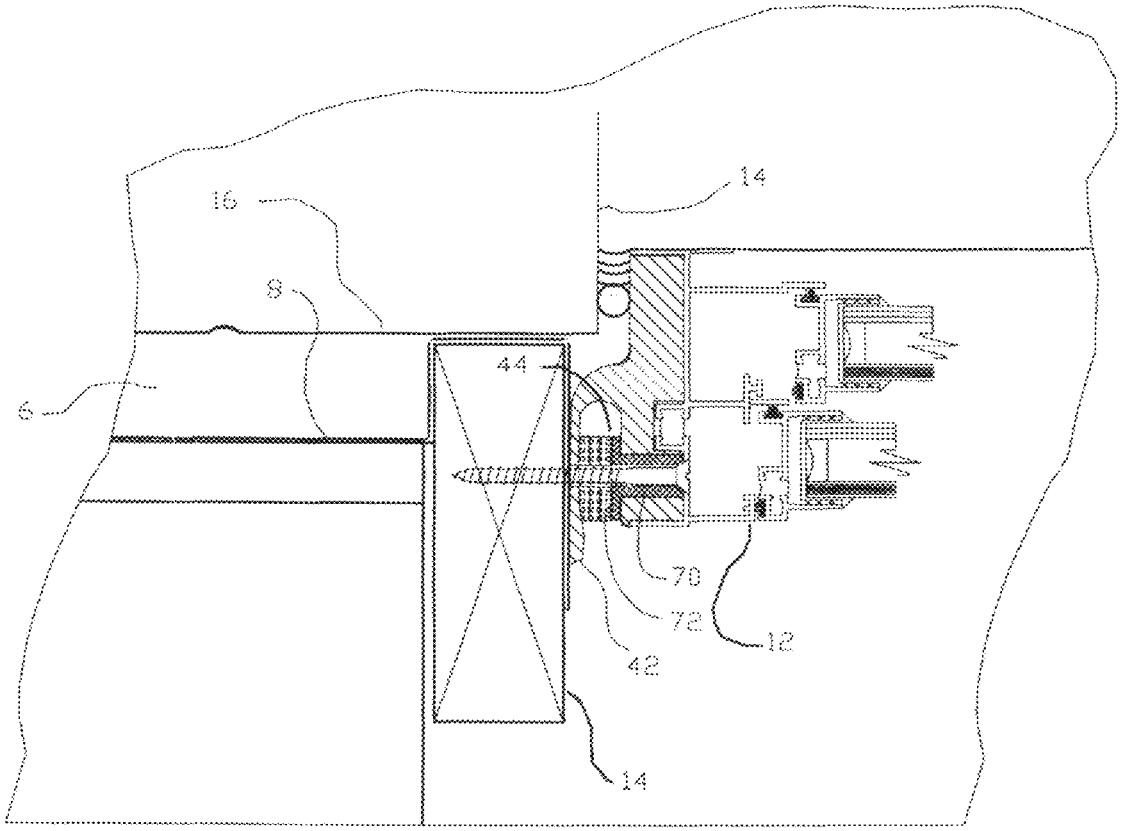
FIG. 7 is a drawing taken along the lines 2-2 of FIG. 1 which shows a further embodiment therewith, comprising a method of shimming through the foam body with a "Shim Post" to the window perimeter.

Such fastening of a foamed filled cavity may be achieved with the use of a shim post 70 shown in FIG. 7. The shim post 70, in conjunction with the polyethylene foam body 28 of an extrusion block 26, utilizes that foam body 28 for support. A length of polystyrene or metal shim tube 72 may be thermoplasticly welded to the foam body 28 of the extrusion block 26 during its manufacturing process. Shimming through the polyethylene foam body 28 to the outer side of the window frame 32 is thereby achieved. The shim post 70 is then shimmed with conventional polystyrene shims 72 to the supporting structure of the window opening 14 Those shims 72 are inserted into the elongated receiving channel 44 of the extrusion blocks 26 and compressed to the building 14 before thermoplastic welding 66 of the perimeter is performed.

I claim:

1. A method of installing a weather sealable, insulatable window frame assembly in an opening in a wall of a building, comprising:

providing a metal frame peripherally around a window sash, said frame having channel-forming, outwardly projecting flanges therearound;

placing an insulating, elongated, extrusion block arrangement within said channel formed by said flanges of said metal frame to form a window frame assembly, said extrusion block having an elongated air fin co-extruded therewith;

inserting said window frame assembly with said extrusion block arrangement therearound, into said opening in said building wall;

inserting a compression rod into a compression rod-receiving channel between said air fin and said extrusion block to compress said air fin against said opening in said building wall and to compress said extrusion block against said metal frame;

attaching an energyzable thermoplastic welding wire to the outer periphery of said air fin and to the inner periphery of said extrusion block; and energyzing said welding wire so as to heat and thermoplastically fuse said inner side of said extrusion block and said air fin against their respective adjacent surfaces of said metal frame or said building wall.

2. The method as recited in claim 1, wherein said extrusion block is of an "h" shape (lower case) in cross section.

3. The method as recited in claim 1, including:

forming a window frame protrusion receiving channel along an inner side of said extrusion block.

4. The method as recited in claim 1, wherein said extrusion block is formed of closed cell polyethylene.

5. The method as recited in claim 1, including:

trimming portions of said compression rod to enable said extrusion block to conform to dimensional irregularities in said opening in said building wall.

6. A method of installing a weather sealable, insulatable window frame assembly in an opening in a wall of a building, comprising:

providing a metal frame peripherally around a window member, said frame having channel-forming, outwardly projecting flanges therearound;

placing an inner side of an insulating, elongated, extrusion block arrangement within said channel formed by said flanges of said metal frame to form a window frame assembly, said extrusion block having an elongated air fin co-extruded on an outer side thereof;

inserting said window frame assembly with said extrusion block arrangement therearound, into said opening in said building wall; and inserting a compression rod into a compression rod-receiving channel between said air fin and said extrusion block to compress said air fin against said building wall and to compress said extrusion block against said metal frame;

inserting a shim post though said extrusion block and into said building wall, to secure said extrusion block to said building wall;

attaching an energyzable thermoplastic welding wire to the outer side of said air fin and to the inner side of said extrusion block;

energyzing said welding wire to thermoplastically weld said inner side of said extrusion block to said metal frame peripherally around said window member; and energyzing said welding wire to thermoplastically welding said outer side of said air fin to said building wall.

7. The method as recited in claim 6, wherein said extrusion block and air fin are of an "h" shape (lower case) in cross section, thereby forming said compression rod receiving channel therebetween.

8. The method as recited in claim 7, wherein said compression rod receiving channel is narrower than said compression rod, to permit said compression rod to compress said air fin and said extrusion block when said compression rod is inserted into said compression rod receiving channel.

9. The method of as recited in claim 6, including:

inserting an L-shaped terminal block into a corner of said opening in said building wall to facilitate a weather seal between adjacent extrusion blocks.

10. The method as recited in claim 6, forming a plurality of elongated gripping serrations on said air fin to enhance its compressive gripping capabilities thereof.

11. A method of installing a weather sealable, insulatable window frame assembly in an opening in a wall of a building, comprising:

providing a metal window frame peripherally around a window member, said metal window frame having channel-forming, outwardly projecting flanges therearound;

placing an inner side of an insulating, elongated, extrusion block arrangement within said channel formed by said flanges of said metal window frame to form a window frame assembly, said extrusion block having an elongated air fin co-extruded on an outer side thereof;

inserting said window frame assembly with said extrusion block arrangement therearound, into said opening in said building wall;

inserting a compression rod into a compression rod-receiving channel between said air fin and said extrusion block to compress said air fin against said building wall and to compress said extrusion block against said metal window frame;

inserting a shim post though said extrusion block and into said building wall, to secure said extrusion block to said building wall, wherein said extrusion block and air fin are of an "h" shape (lower case) in cross section, thereby forming said compression rod receiving channel therebetween;

attaching an energyzable thermoplastic welding wire to the outer periphery of said air fin and to the inner periphery of said extrusion block; and energyzing said welding wire so as to heat and thermoplastically fuse said inner side of said extrusion block and said air fin against their respective adjacent surfaces of said metal window frame or said building wall.

* * * * *